US008054149B2

(12) United States Patent
Tung et al.

(10) Patent No.: US 8,054,149 B2
(45) Date of Patent: Nov. 8, 2011

(54) MONOLITHIC INDUCTOR

(75) Inventors: Mean-Jue Tung, Hsinchu (TW); Wen-Song Ko, Hsinchu (TW); Yu-Ting Huang, Hsinchu (TW); Yen-Ping Wang, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 489 days.

(21) Appl. No.: 11/822,230

(22) Filed: Jul. 3, 2007

(65) Prior Publication Data

US 2008/0157912 A1 Jul. 3, 2008

(30) Foreign Application Priority Data

Dec. 28, 2006 (TW) ..... 95149402 A

(51) Int. Cl.

| | |
|---|---|
| ***H01F 27/02*** | (2006.01) |
| ***H01F 27/36*** | (2006.01) |
| ***H01F 38/12*** | (2006.01) |
| ***H01F 21/00*** | (2006.01) |
| ***H01F 5/00*** | (2006.01) |

(52) U.S. Cl. .... 336/83; 336/84 R; 336/84 M; 336/84 C; 336/110; 336/200

(58) Field of Classification Search ..... 336/100, 336/83, 84 R, 84 M, 84 C, 200, 233, 11
See application file for complete search history.

(56) References Cited

U.S. PATENT DOCUMENTS

| | | | | |
|---|---|---|---|---|
| 3,968,465 | A * | 7/1976 | Fukui et al. | 336/110 |
| 6,392,525 | B1 * | 5/2002 | Kato et al. | 336/233 |
| 6,734,771 | B2 * | 5/2004 | Okita et al. | 335/229 |
| 6,791,446 | B2 * | 9/2004 | Sato et al. | 336/110 |
| 7,170,378 | B2 * | 1/2007 | Fujiwara et al. | 336/83 |
| 2004/0113744 | A1 | 6/2004 | Watanabe et al. | |

FOREIGN PATENT DOCUMENTS

| | | | |
|---|---|---|---|
| CN | 1433033 | A | 7/2003 |
| CN | 1506983 | A | 6/2004 |
| EP | 1263005 | A1 | 12/2002 |
| JP | 2006-294733 | A | 10/2006 |
| JP | 2006294733 | A * | 10/2006 |
| TW | 584873 | | 4/2004 |

OTHER PUBLICATIONS

English translation of JP2006294733.*

* cited by examiner

*Primary Examiner* — Anh Mai
*Assistant Examiner* — Ronald Hinson
(74) *Attorney, Agent, or Firm* — Birch, Stewart, Kolasch & Birch, LLP

(57) ABSTRACT

This invention discloses a monolithic inductor including a body made by compressing a magnetic powder, a coil positioned in the body, and a permanent magnet positioned in the body and in a magnetic circuit formed by applying current to the coil. The monolithic inductor of this invention includes the magnetic body containing the permanent magnet and the coil. The permanent magnet in the magnetic circuit (path of magnetic flux lines) formed by applying current to the coil generates a reverse-bias magnetic field, thereby increasing the operating range of the magnetic body, the saturation current of the magnetic body, and the rated current of the inductor.

12 Claims, 7 Drawing Sheets

MONOLITHIC INDUCTOR

BACKGROUND OF THE INVENTION

1. Field of the Invention

The present invention relates to monolithic inductors, and in particular to a monolithic inductor for increasing saturation current of the magnetic material of the inductor, and the rated current of the inductor, by means of a reverse-bias or forward-bias magnetic field generated in a magnetic circuit by a permanent magnet.

2. Description of the Prior Art

In general, every inductor is associated with a rated current, or a critical current, which is defined by either temperature rise or inductance decrease. The temperature rise current is the DC current value with which the inductor body has a temperature increase up to a rated value, for example, 40° C. On the other hand, with the direct current increasing to the saturation current of the magnetic material of the inductor, inductance decreases, thereby results in current surge. The saturation current is the DC current value with which the inductance decreases down to a rated amount, for example, 20%.

At present, a method for overcoming the aforementioned problem about low rated current (saturated current) and inductance decrease is addressed by a wire-wound iron powder core which, however, is unfit for small-sized and low-profile products.

Accordingly, an issue calling for an urgent solution involves developing a monolithic and low-profile inductor characterized by a relatively great operating range (that is, rated current) and prevent the inductance decrease due to high current operation.

SUMMARY OF THE INVENTION

The present invention provides a monolithic inductor for increasing the operating range of a magnetic material of the inductor, the saturation current of the magnetic material of the inductor, and the rated current of the inductor.

In one embodiment, the present invention provides a monolithic inductor comprising: a body made by compressing a magnetic powder; a coil positioned in the body; and a permanent magnet positioned in the body and in a magnetic circuit formed by applying current to the coil.

In another embodiment of the monolithic inductor of the present invention, the magnetic field of the permanent magnet is anti-parallel or parallel to the magnetic field formed by applying current to the coil.

In another embodiment of the monolithic inductor of the present invention, the permanent magnet is positioned inside a hollow region circumferentially defined by the coil, has a cross section equal to that of the hollow region circumferentially defined by the coil, and has a thickness ranging from 0.1 mm to a thickness of the body.

In another embodiment of the monolithic inductor of the present invention, the permanent magnet is positioned outside a hollow region circumferentially defined by the coil and has a cross section with area denoted by A and a thickness by B. The area A is not less than an area of the hollow region circumferentially defined by the coil and not greater than a cross-sectional area of the body. The thickness B is not less than 0.1 mm and not greater than a distance between a surface of the body and one side of the coil opposite the surface of the body.

In another embodiment of the monolithic inductor of the present invention, a thickness of the body is denoted by C and a height of the coil by D, and the thickness of the permanent magnet ranges from 0.1 mm to ((C−D)/2).

In another embodiment of the monolithic inductor of the present invention, the body is made of a magnetically permeable metal selected from the group consisting of iron (Fe), cobalt (Co), nickel (Ni), and a compound thereof; alternatively, the body is made of one selected from the group consisting of iron (Fe), cobalt (Co), nickel (Ni), and a magnetic oxide thereof, and the magnetic metal oxide is one selected from the group consisting of manganese-zinc (MnZn) ferrite, nickel-zinc (NiZn) ferrite, copper-zinc (CuZn) ferrite, and lithium-zinc (LiZn) ferrite.

In the preceding embodiment of the monolithic inductor of the present invention, the permanent magnet is made of one selected from the group consisting of neodymium-iron-boron (NdFeB), samarium-cobalt (SmCo), aluminum-nickel-cobalt (AlNiCo), barium-ferrite (Ba-ferrite), and strontium-ferrite (Sr-ferrite); alternatively, the permanent magnet is primarily made of one selected from the group consisting of neodymium-iron-boron (NdFeB), samarium-cobalt (SmCo), aluminum-nickel-cobalt (AlNiCo), barium-ferrite (Ba-ferrite), and strontium-ferrite (Sr-ferrite) and secondarily made of a magnetically permeable metal selected from the group consisting of iron (Fe), cobalt (Co), nickel (Ni), the metallic compound, and the magnetic metal oxide thereof.

In the preceding embodiment of the monolithic inductor of the present invention, the coil is made of one selected from the group consisting of copper (Cu), aluminum (Al), silver (Ag), and a combination thereof.

As described above, a monolithic inductor of the present invention comprises a coil positioned in a body made of a magnetic material, so as to increase the operating range of the magnetic material of the inductor, the saturation current of the magnetic material of the inductor, and the rated current of the inductor, by means of a forward-bias magnetic field, or preferably a reverse-bias magnetic field, generated in the magnetic circuit by the permanent magnet. The monolithic inductor of the present invention can provide a high-current, small-sized, and low-profile product to eliminate the limitation of rated current, inductance decrease, and current surge which may otherwise occur to the conventional product. The industrial application is including power inductors, magnetic cores, and power modules.

DETAILED DESCRIPTION OF PREFERRED EMBODIMENTS

The following specific embodiments are provided to illustrate the present invention. Persons skilled in the art can readily gain an insight into other advantages and features of the present invention based on the contents disclosed in this specification.

Figure 1A:
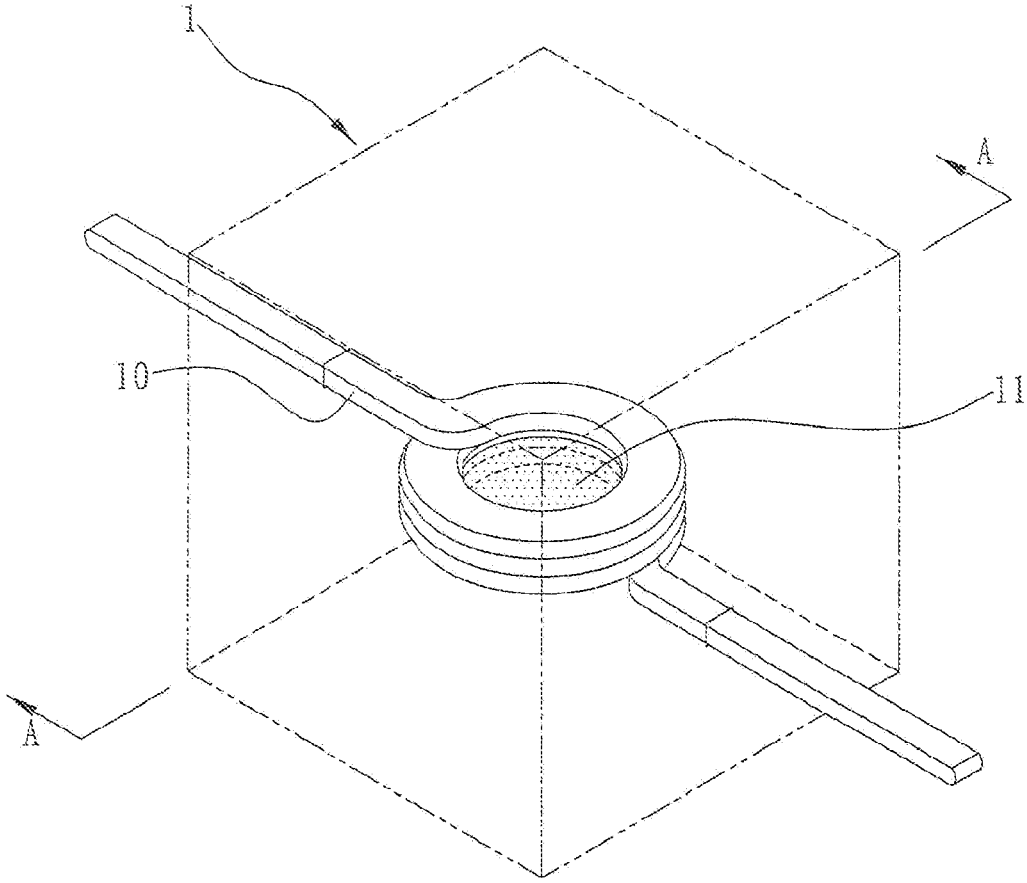
FIG. 1A is a perspective view showing the first preferred embodiment of a monolithic inductor of the present invention.
Figure 1B:
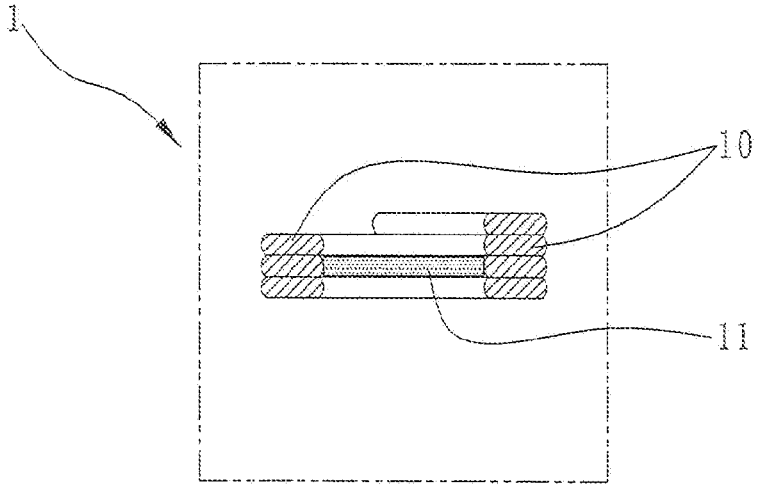
FIG. 1B is a cross-sectional view taken along the section line A-A of FIG. 1A.

Referring to FIGS. 1A and 1B, a perspective view showing the first preferred embodiment of a monolithic inductor of the present invention and a cross-sectional view taken along the section line A-A of FIG. 1A, the monolithic inductor comprises a body 1, and a coil 10 and permanent magnet 11 both positioned in the body 1. The body 1 is made by compressing a magnetic powder. The body 1 is made of a magnetically permeable metal selected from the group consisting of iron (Fe), cobalt (Co), nickel (Ni), a compound thereof, and a magnetic oxide thereof (such as manganese-zinc (MnZn) ferrite, nickel-zinc (NiZn) ferrite, copper-zinc (CuZn) ferrite, and lithium-zinc (LiZn) ferrite). In this embodiment, the permanent magnet 11 is positioned inside the hollow region circumferentially defined by the coil 10, and the permanent magnet 11 is primarily made of one selected from the group consisting of neodymium-iron-boron (NdFeB), samarium-cobalt (SmCo), aluminum-nickel-cobalt (AlNiCo), barium-ferrite (Ba-ferrite), and strontium-ferrite (Sr-ferrite) and secondarily made of a magnetically permeable metal selected from the group consisting of iron (Fe), cobalt (Co), nickel (Ni), a compound thereof, and a magnetic oxide thereof (such as manganese-zinc (MnZn) ferrite, nickel-zinc (NiZn) ferrite, copper-zinc (CuZn) ferrite, and lithium-zinc (LiZn) ferrite). The coil 10 is made of one selected from the group consisting of copper (Cu), aluminum (Al), silver (Ag), and a combination thereof. In this preferred embodiment, the coil 10 is made from a flat wire or a round wire.

The permanent magnet 11 of preferred embodiment is positioned inside a hollow region circumferentially defined by the coil 10; as shown in the drawings, the coil 10 is a circular coil, whereas the permanent magnet 11 is disk-shaped and embedded in the hollow region circumferentially defined by the coil 10.

The monolithic inductor of the present invention comprises the permanent magnet 11 and coil 10 positioned in the body 1 made of a magnetic material, and the permanent magnet 11 in the magnetic circuit (path of magnetic flux lines) formed by applying current to the coil 10 generates a reverse-bias magnetic field, thereby increasing the operating range of the body 1 made of the magnetic material, the saturation current of the magnetic material, and the rated current of the inductor.

Experimental data of four experimental embodiments implemented with regard to an inductor having the aforesaid structure are as followed.

First Experimental Embodiment and Second Experimental Embodiment

The monolithic inductor of the first experimental embodiment and second experimental embodiment comprises the body of dimensions 12×12×5.4 mm, the coil formed by three-turn winding of a flat copper wire, and the permanent magnet made by compressing neodymium-iron-boron (NdFeB) powder to form a disk of thickness 2.7 mm and positioned inside the coil. In the first experimental embodiment the magnetization of the permanent magnet is anti-parallel to a magnetic field formed by applying current to the coil. In the second experimental embodiment the magnetization of the permanent magnet is parallel to a magnetic field formed by applying current to the coil. For the purpose of comparison, an inductor without inbuilt permanent magnet (hereinafter referred to as the first control embodiment) are also implemented. The dimensions of the inductor in the first control embodiment is the same as those of the first and second experimental embodiment, but the number of turns of the coil of the inductor in the first control embodiment has to be adjusted in order to adjust the inductance of the inductor in the first control embodiment similar to the inductance of the inductors in the first and second experimental embodiments. Inductance characteristics of the first experimental embodiment, second experimental embodiment, and first control embodiment is measured and shown in Table 1 below. The expression "ΔL %@40 A" used in Table 1 denotes the rate of change of inductance measured at an applied DC current of 40 amperes.

TABLE 1

| | presence of permanent magnet | magnet thickness | magnetization direction | Lo (uH) | ΔL % @40 A |
|---|---|---|---|---|---|
| first control embodiment | No | — | — | 0.211 | −11.4 |
| first experimental embodiment | Yes | 2.7 mm | reverse | 0.182 | 1.1 |
| second experimental embodiment | Yes | 2.7 mm | forward | 0.181 | −1.7 |

Figure 2:
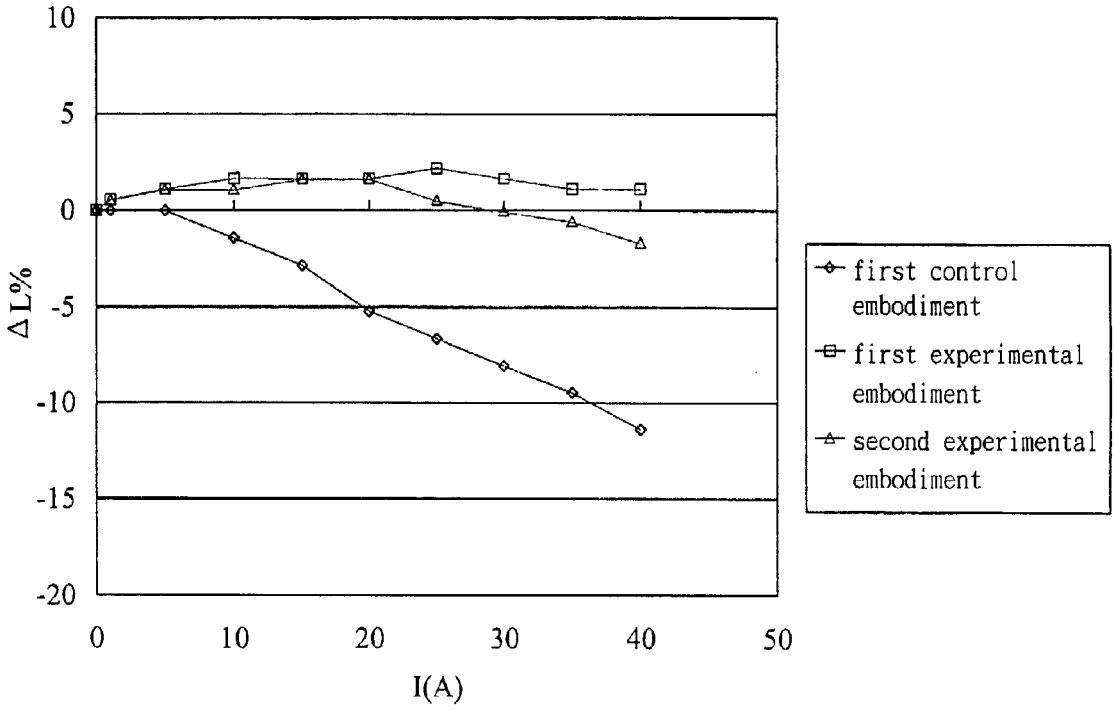
FIG. 2 is a graph showing the respective effects of applied currents on inductance in the first experimental embodiment, second experimental embodiment, and first control embodiment.

Refer to FIG. 2 for an insight into the inductance characteristics in the first experimental embodiment, second experimental embodiment, and first control embodiment. As indicated by the experimental results, inductance decrease is reduced by the presence of the inbuilt permanent magnet and preferably reverse magnetization.

Third Experimental Embodiment and Fourth Experimental Embodiment

The monolithic inductor of the third experimental embodiment and fourth experimental embodiment comprises the body of dimensions 12×12×5.4 mm, the coil formed by three-turn winding of a flat copper wire, and the permanent magnet made by compressing neodymium-iron-boron (NdFeB) powder to form a disk of thickness 1.35 mm and positioned inside the coil. In the third experimental embodiment the magnetization of the permanent magnet is anti-parallel to the magnetic field formed by applying current to the coil. In the fourth experimental embodiment the magnetization of the permanent magnet is parallel to the magnetic field formed by applying current to the coil. For the purpose of comparison, an inductor without inbuilt permanent magnet (hereinafter referred to as the second control embodiment) is also implemented. The dimension of the inductor in the second control embodiment is the same as those of the third and fourth experimental embodiments, but the number of turns of the coil of the inductor in the second control embodiment has to be adjusted in order to adjust the inductance of the inductor in the second control embodiment similar to the inductance of the inductors in the third and fourth experimental embodiments. Inductance characteristics of the third experimental embodiment, fourth experimental embodiment, and second control embodiment are measured and shown in Table 2 below.

TABLE 2

| | presence of permanent magnet | magnet thickness | magnetization direction | Lo (uH) | ΔL % @40 A |
|---|---|---|---|---|---|
| second control embodiment | No | — | — | 0.226 | −11.5 |
| third experimental embodiment | Yes | 1.35 mm | reverse | 0.218 | −1.29 |
| fourth experimental embodiment | Yes | 1.35 mm | forward | 0.218 | −2.29 |

Figure 3:
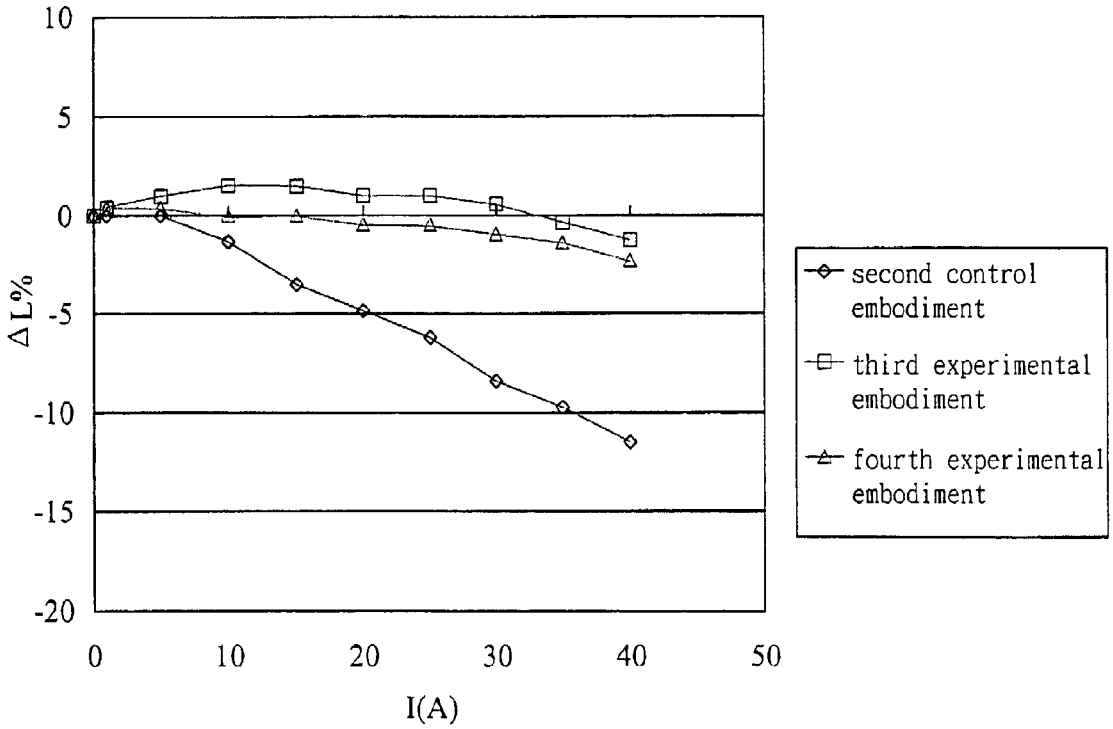
FIG. 3 is a graph showing the respective effects of applied currents on inductance in the third experimental embodiment, fourth experimental embodiment, and second control embodiment.

Refer to FIG. 3 for an insight into inductance characteristics in the third experimental embodiment, fourth experimental embodiment, and second control embodiment. As indicated by the experimental results, inductance decrease is reduced greatly in the presence of the inbuilt permanent magnet, and preferably reverse magnetization.

Figure 1C:
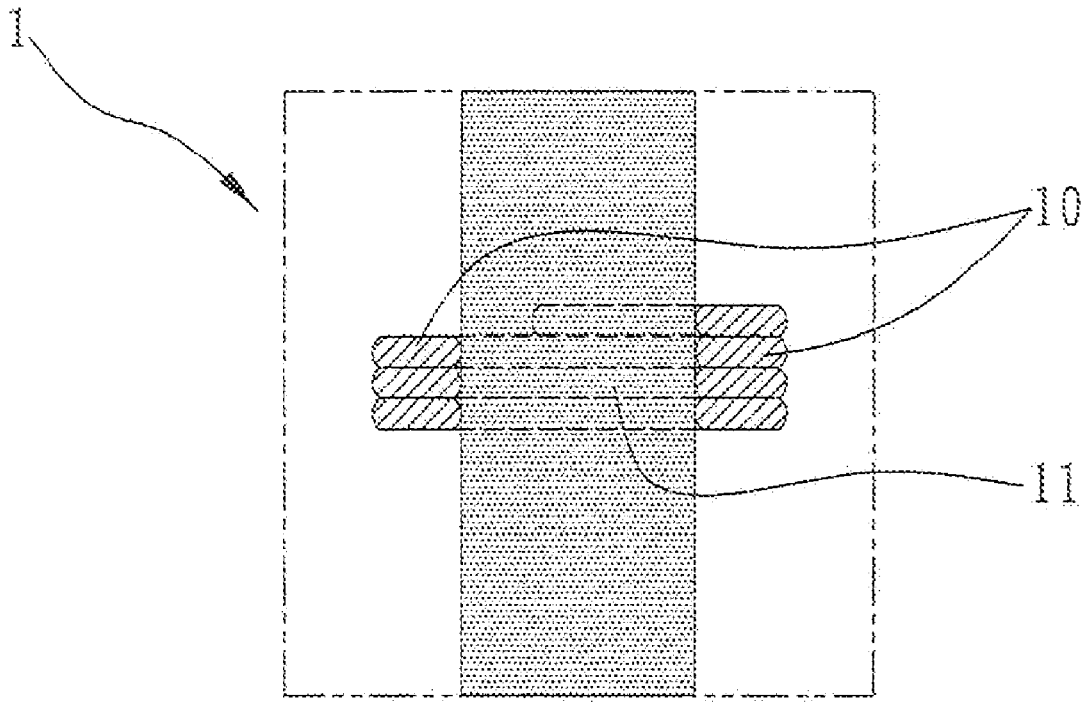
FIG. 1(C) is a cross-sectional view showing a variant of the first preferred embodiment.

As indicated by the above results of the comparison between the first and second experimental embodiments and first control embodiment and the comparison between the third and fourth experimental embodiments and second control embodiment, the inductance characteristics is are affected by forward/reverse magnetization of the magnet and magnet thickness. As shown in Tables 1 and 2, the thicker the magnet is, the less the inductance decrease is. However, in the preferred embodiment, the permanent magnet is positioned inside the hollow region circumferentially defined by the coil, has an area equal to the area of the hollow region circumferentially defined by the coil, and has a thickness ranging from 0.1 mm to the thickness of the body. FIGS. 1(A) and 1(B) show that the thickness of the permanent magnet is less than the thickness of the body, while FIG. 1(C) shows that the thickness of the permanent magnet is equal to the thickness of the body.

Unlike the first to fourth experimental embodiments that recite positioning the permanent magnet in the coil and equating the area of the permanent magnet with the area of the hollow region circumferentially defined by the coil, two more experimental embodiments, that is, the fifth experimental embodiment and sixth experimental embodiment, recite the area of the permanent magnet less than the area of the hollow region circumferentially defined by the coil and the area of the permanent magnet equal to the area of the hollow region circumferentially defined by the coil respectively, for comparative analysis of inductance variation in the fifth experimental embodiment and sixth experimental embodiment.

Fifth Experimental Embodiment and Sixth Experimental Embodiment

The monolithic inductor of the fifth experimental embodiment and sixth experimental embodiment comprises the body of dimensions 12×12×5 mm, the body made of an iron powder, the coil with an inner diameter 4 mm (radius 2 mm) and a full height 2 mm form by a wire with 1.8 mm width, and the permanent magnet made of neodymium-iron-boron (NdFeB). In the fifth experimental embodiment, the permanent magnet has a radius of 1.5 mm and a thickness of 1 mm. In the sixth experimental embodiment, the permanent magnet has a radius of 2 mm and a thickness of 1 mm. The inductors in the fifth and sixth experimental embodiments and an inductor without inbuilt permanent magnet (hereinafter referred to as the third control embodiment) are compared with one another in terms of current characteristics. A point to note is that the number of turns of the coils of the inductors in the third control embodiment, fifth experimental embodiment, and sixth experimental embodiment have to be adjusted in order to provide equal inductances. Inductances of the fifth experimental embodiment, sixth experimental embodiment, and third control embodiment in the presence of applied direct currents of 20 A and 40 A are measured and shown in Table 3 below.

TABLE 3

| | magnet radius (mm) | magnet thickness (mm) | ΔL % @20 A | ΔL % @40 A |
|---|---|---|---|---|
| third control embodiment | magnet is absent | | −8.63 | −20.8 |
| fifth experimental embodiment | 1.5 | 1 | −17.3 | −32.0 |
| sixth experimental embodiment | 2 | 1 | 3.72 | 6.51 |

As shown in Table 3, in comparison with the third control embodiment, inductance variation of the fifth experimental embodiment (the radius of magnetic is less than the radius of coil) is large and variation of the sixth experimental embodiment is small (the radius of magnet is equal to the radius of coil, that is, the permanent magnet has an area equal to an area of the hollow region circumferentially defined by the coil).

As indicated by the results of the fifth and sixth experimental embodiments, the variation of inductance is also affected by radius (area) of permanent magnet and thickness of permanent magnet.

Seventh Experimental Embodiment

The dimensions and constituent material of the inductor, and the internal diameter, wire width, coil height, and constituent material of the coil recited in the seventh experimental embodiment are the same as that recited in the fifth and sixth experimental embodiments and therefore are not described in detail herein. However, the permanent magnet of the seventh experimental embodiment has a radius of 2 mm but different thicknesses as shown in Table 4 below. Inductances of the inductors having inbuilt permanent magnets with different thicknesses and inductance of an inductor without inbuilt permanent magnet in the seventh experimental embodiment in the presence of applied direct currents of 20 A and 40 A are measured and shown in Table 4 below.

TABLE 4

| magnet radius (mm) | magnet thickness (mm) | Δ L % @20 A | Δ L % @40 A |
|---|---|---|---|
| magnet is absent | | −8.63 | −20.8 |
| 2 | 0.1 | 6.94 | 7.08 |
| 2 | 0.2 | 7.09 | 11.01 |
| 2 | 0.3 | 6.56 | 11.09 |
| 2 | 0.4 | 5.51 | 10.24 |
| 2 | 0.5 | 4.75 | 8.90 |
| 2 | 1 | 3.72 | 6.51 |
| 2 | 2 | 1.17 | 1.86 |

TABLE 4-continued

| magnet radius (mm) | magnet thickness (mm) | Δ L % @20 A | Δ L % @40 A |
|---|---|---|---|
| 2 | 3 | 0.51 | 1.07 |
| 2 | 5 | 1.9 | 3.2 |

As indicated by the results of the seventh experimental embodiment, inductance variation of the inductors having a magnet area equal to the area of the hollow region circumferentially defined by the coil (i.e., magnet radius is equal to coil radius) and magnet thickness ranging from 0.1 mm to 5 mm (inductor full thickness, i.e., body thickness) is less than inductance variation of the inductor without inbuilt permanent magnet.

Figure 4:
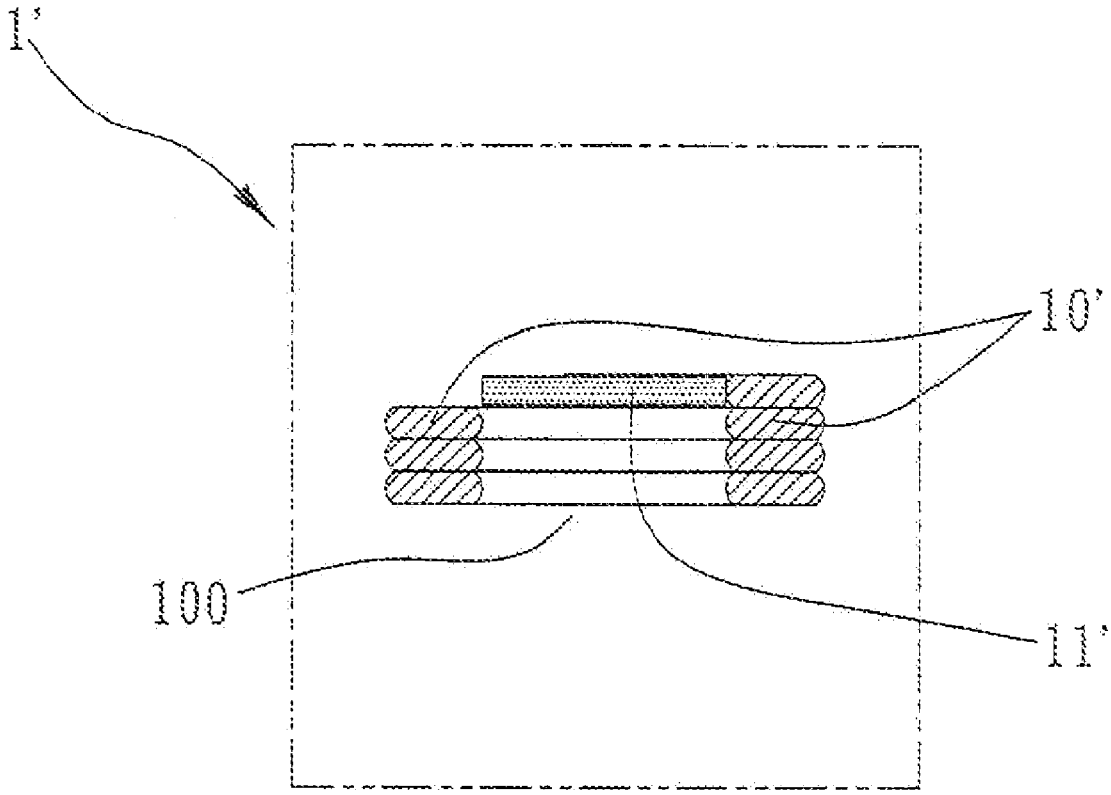
FIG. 4 is a cross-sectional view showing the second preferred embodiment of a monolithic inductor of the present invention.

In addition to the first preferred embodiment in which the permanent magnet 11 of the monolithic inductor of the present invention can be positioned inside the hollow region circumferentially defined by the coil 10, the permanent magnet of a monolithic inductor of the present invention can also be positioned at an opening formed on one end of the hollow region circumferentially defined by a coil, as shown in FIG. 4, a cross-sectional view showing the second preferred embodiment of the monolithic inductor 1' of the present invention, a permanent magnet 11' of a monolithic inductor 1' of the present invention being positioned at an opening 100 formed on one end of the hollow region circumferentially defined by a coil 10' and yet serves the same purpose as the first to seventh experimental embodiments.

As regards the preferred embodiments or experimental embodiments, the permanent magnet positioned inside the hollow region circumferentially defined by the coil has an area equal to the area of the hollow region circumferentially defined by the coil and has a thickness ranging from 0.1 mm to the thickness of the body.

Figure 5A:
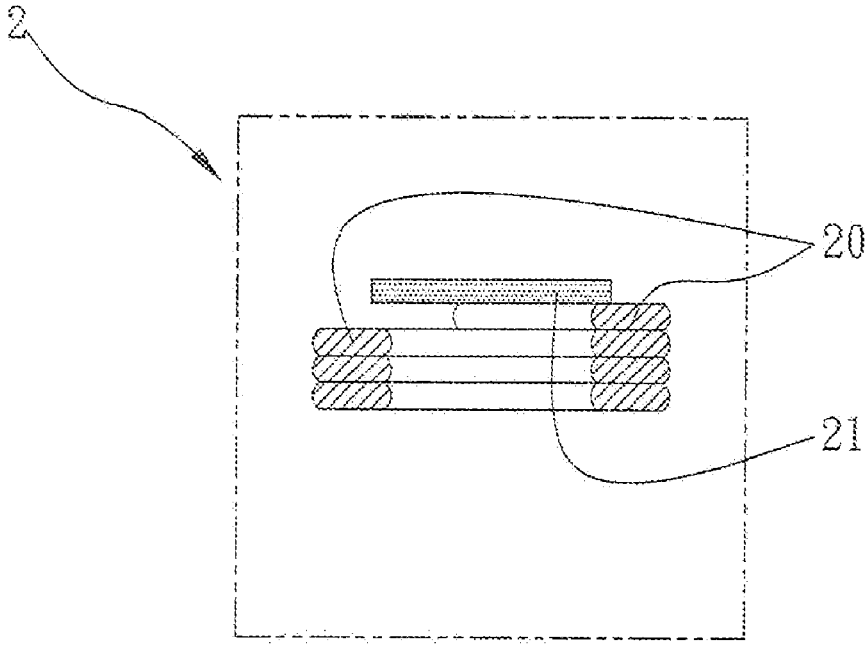
FIG. 5A is a cross-sectional view showing the third preferred embodiment of a monolithic inductor of the present invention.

In addition to the first and second preferred embodiments of a monolithic inductor of the present invention, both of which recite positioning a permanent magnet inside a hollow region circumferentially defined by a coil as shown in FIGS. 1B and 4, the third preferred embodiment of a monolithic inductor of the present invention recites positioning a permanent magnet 21 outside a coil 20 (that is, on the surface of the coil 20) and in the magnetic circuit formed by applying current to the coil 20 as shown in FIG. 5A, a cross-sectional view showing the third preferred embodiment of a monolithic inductor 2 of the present invention.

Inductance of the monolithic inductor 2 shown in FIG. 5A also depends on thickness and area of the permanent magnet 21, as recited in the eighth experimental embodiment below.

Eighth Experimental Embodiment

The dimensions and constituent material of the inductor, and the internal diameter, wire width, full height, and constituent material of the coil recited in the eighth experimental embodiment are the same as that recited in the fifth and sixth experimental embodiments and therefore are not described in detail herein. However, radius and thickness of the permanent magnet of the eighth experimental embodiment are shown in Table 5 below. Inductances of the inductors having inbuilt permanent magnets with different thicknesses and areas and inductance of an inductor without inbuilt permanent magnet in the eighth experimental embodiment in the presence of applied direct currents of 20 A and 40 A are measured and shown in Table 5 below.

TABLE 5

| magnet radius (mm) | magnet thickness (mm) | Δ L % @20 A | Δ L % @40 A |
|---|---|---|---|
| magnet is absent | | −8.63 | −20.8 |
| 2 | 0.5 | −5.2 | −13.6 |
| 2.9 | 0.5 | −3.8 | −15.1 |
| 3.8 | 0.5 | −2.7 | −13.8 |
| 5 | 0.5 | −1.3 | −14.7 |
| 2 | 1 | −6.8 | −15.6 |
| 2.9 | 1 | −6.2 | −10.0 |
| 3.8 | 1 | −4.6 | −8.8 |
| 5 | 1 | −4.9 | −9.1 |
| 2 | 1.5 | 1.7 | 0.6 |
| 2.9 | 1.5 | 5.1 | 7.5 |
| 3.8 | 1.5 | 3.5 | 7.4 |
| 5 | 1.5 | 2.3 | 4.0 |

As indicated by the results of the eighth experimental embodiment, inductance variation of the inductors having a permanent magnet positioned on the surface of the coil with magnet radius ranging from 2 mm to 5 mm, and magnet thickness ranging from 0.5 mm to 1.5 mm (i.e., the distance between a surface of the body and one side of the coil opposite the surface of the body) is less than inductance variation of the inductor without inbuilt permanent magnet.

Figure 5B:
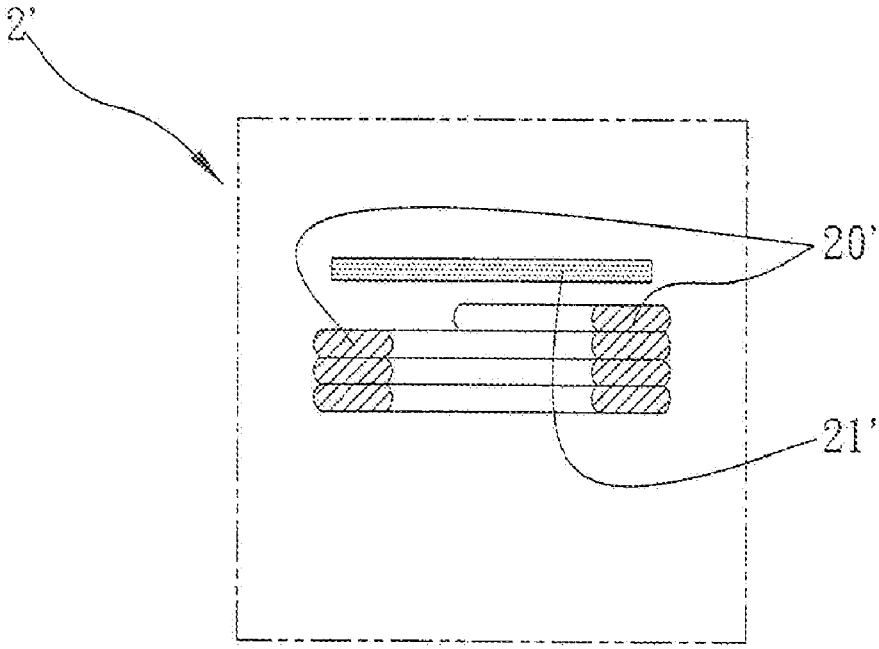
FIG. 5B is a cross-sectional view showing the fourth preferred embodiment of a monolithic inductor of the present invention.

As regards a monolithic inductor 2' of the fourth preferred embodiment, a permanent magnet 21' is positioned outside a coil 20' and spaced apart from the coil 20' by a predetermined distance as shown in FIG. 5B, a cross-sectional view showing the fourth preferred embodiment of the monolithic inductor 2' of the present invention.

Figure 5C:
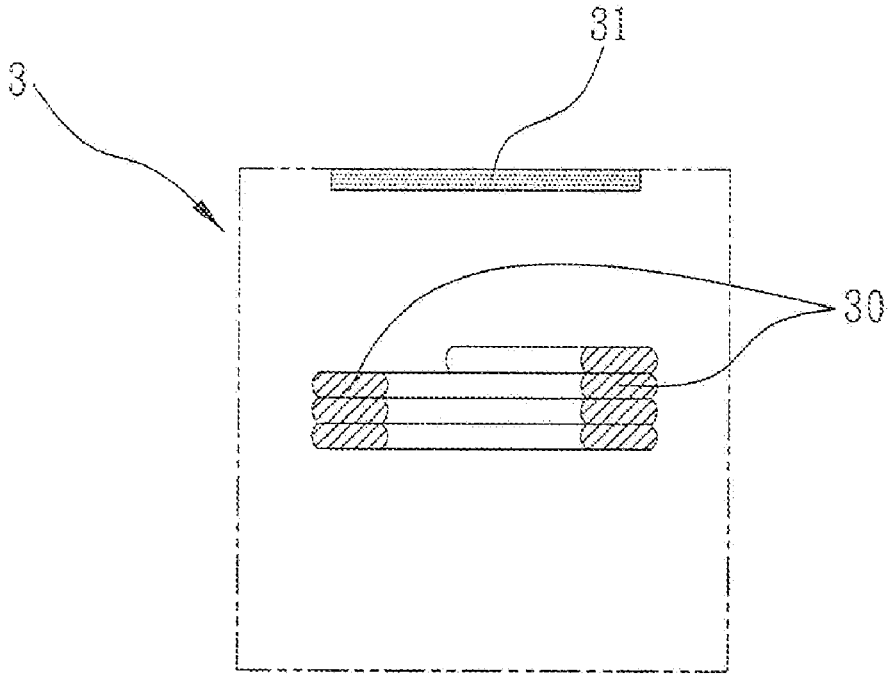
FIG. 5C is a cross-sectional view showing the fifth preferred embodiment of a monolithic inductor of the present invention.

Referring to FIG. 5C, a cross-sectional view showing the fifth preferred embodiment of a monolithic inductor 3 of the present invention, the monolithic inductor 3 of the fifth preferred embodiment differs from the inductor 2' shown in FIG. 5B in the way that the distance between a permanent magnet 31 and the coil 20' of the fifth preferred embodiment is far greater and is embedded in the body 3.

Figure 5D:
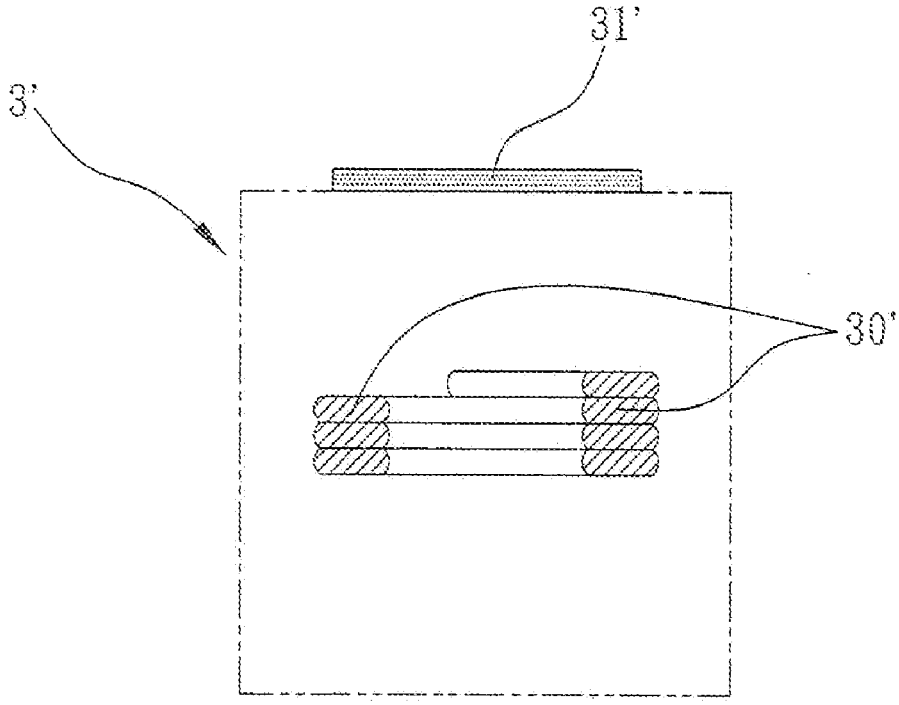
FIG. 5D is a cross-sectional view showing the sixth preferred embodiment of a monolithic inductor of the present invention.

Referring to FIG. 5D, a cross-sectional view showing the sixth preferred embodiment of a monolithic inductor 3' of the present invention, the monolithic inductor 3' of the sixth preferred embodiment differs from the inductor 3 shown in FIG. 5C in the way that the distance between the permanent magnet 31' and the coil 30' of the sixth preferred embodiment is much greater and is positioned on the surface of the body 3'.

According to FIGS. 5A to 5D, a permanent magnet is positioned outside a hollow region circumferentially defined by the coil and has an area denoted by A and a thickness by B, where the area A is not less than an area of the hollow region circumferentially defined by the coil and not greater than a cross-sectional area of the body, and the thickness B is not less than 0.1 mm and not greater than a distance between a surface of the body and one side of the coil opposite the surface of the body; a thickness of the body is denoted by C and a height of the coil by D, and the thickness of the permanent magnet ranges from 0.1 mm to ((C−D)/2).

As described above, a monolithic inductor of the present invention comprises a coil and a permanent magnet positioned in a body made of a magnetic material, so as to increase the operating range of the magnetic material of the inductor, the saturation current of the magnetic material of the inductor, and the rated current of the inductor, by means of a forward-bias magnetic field, or preferably a reverse-bias magnetic field, generated in the magnetic circuit by the permanent magnet. The monolithic inductor of the present invention can provide a high-current, small-sized, and low-profile product to eliminate the limitation of rated current, inductance decrease, and current surge which may otherwise occur to the conventional product. The industrial application is including power inductors, magnetic cores, and power modules.

The aforesaid embodiments merely serve as the preferred embodiments of the present invention. The aforesaid embodiments should not be construed as to limit the scope of the present invention in any way. Hence, any other changes can actually be made in the present invention. It will be apparent to those skilled in the art that all equivalent modifications or changes made to the present invention, without departing from the spirit and the technical concepts disclosed by the present invention, should fall within the scope of the appended claims.

What is claimed is:

1. A monolithic inductor, comprising:

a body made by compressing a magnetic powder;

a coil positioned in the body; and a permanent magnet positioned in the body and in a magnetic circuit formed by applying current to the coil, wherein the permanent magnet is positioned inside a hollow region circumferentially defined by the coil, and has an area equal to an area of the hollow region circumferentially defined by the coil and a thickness ranging from 0.1 mm to a thickness of the body.

2. The monolithic inductor according to claim 1, wherein the magnetic field of the permanent magnet is parallel to a magnetic field formed by applying current to the coil.

3. The monolithic inductor according to claim 1, wherein the magnetic field of the permanent magnet is anti-parallel to a magnetic field formed by applying current to the coil.

4. The monolithic inductor according to claim 1, wherein the body is made of a magnetically permeable metal.

5. The monolithic inductor according to claim 4, wherein the metal is one selected from the group consisting of iron (Fe), cobalt (Co), nickel (Ni), and a compound thereof.

6. The monolithic inductor according to claim 1, wherein the body is made of a magnetic oxide of one selected from the group consisting of iron (Fe), cobalt (Co), and nickel (Ni).

7. The monolithic inductor according to claim 6, wherein the magnetic oxide is one selected from the group consisting of manganese-zinc (MnZn) ferrite, nickel-zinc (NiZn) ferrite, copper-zinc (CuZn) ferrite, and lithium-zinc (LiZn) ferrite.

8. The monolithic inductor according to claim 1, wherein the permanent magnet is made of one selected from the group consisting of neodymium-iron-boron (NdFeB), samarium-cobalt (SmCo), aluminum-nickel-cobalt (AlNiCo), barium-ferrite (Ba-ferrite), and strontium-ferrite (Sr-ferrite).

9. The monolithic inductor according to claim 1, wherein the permanent magnet is primarily made of one selected from the group consisting of neodymium-iron-boron (NdFeB), samarium-cobalt (SmCo), aluminum-nickel-cobalt (AlNiCo), barium-ferrite (Ba-ferrite), and strontium-ferrite (Sr-ferrite) and secondarily made of a magnetically permeable metal selected from the group consisting of metal, metallic compound, and magnetic metal oxide.

10. The monolithic inductor according to claim 9, wherein the material having magnetic permeability is one selected from the group consisting of iron (Fe), cobalt (Co), nickel (Ni), a compound thereof, and a magnetic oxide thereof.

11. The monolithic inductor according to claim 10, wherein the magnetic metal oxide is one selected from the group consisting of manganese-zinc (MnZn) ferrite, nickel-zinc (NiZn) ferrite, copper-zinc (CuZn) ferrite, and lithium-zinc (LiZn) ferrite.

12. The monolithic inductor according to claim 1, wherein the coil is made of one selected from the group consisting of copper (Cu), aluminum (Al), silver (Ag), and a combination thereof.

* * * * *